US008033796B2

(12) United States Patent
Kameya et al.

(10) Patent No.: US 8,033,796 B2
(45) Date of Patent: Oct. 11, 2011

(54) MOTOR-MOUNTED INTERNAL GEAR PUMP AND MANUFACTURING METHOD THEREOF AND ELECTRONIC EQUIPMENT

(75) Inventors: Hirotaka Kameya, Tsuchiura (JP); Masato Nakanishi, Tokyo (JP); Yuuichi Yanagase, Namegata (JP); Eiji Sato, Kasumigaura (JP); Kouji Aizawa, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 1098 days.

(21) Appl. No.: 11/883,937

(22) PCT Filed: May 30, 2006

(86) PCT No.: PCT/JP2006/310767
§ 371 (c)(1),
(2), (4) Date: Aug. 8, 2007

(87) PCT Pub. No.: WO2006/129657
PCT Pub. Date: Dec. 7, 2006

(65) Prior Publication Data

US 2008/0159885 A1 Jul. 3, 2008

(30) Foreign Application Priority Data

May 31, 2005 (JP) ..... 2005-158396

(51) Int. Cl.
*F04B 49/06* (2006.01)

(52) U.S. Cl. ..... 417/44.11; 417/410.4; 418/171; 418/204; 361/698

(58) Field of Classification Search ..... 417/44.11, 417/410.4; 418/166, 171, 195, 204; 361/698
See application file for complete search history.

(56) References Cited

U.S. PATENT DOCUMENTS 2,871,793 A * 2/1959 Michie et al. ..... 417/356
(Continued)

FOREIGN PATENT DOCUMENTS

| | | | |
|---|---|---|---|
| JP | 60-81489 | A | 5/1985 |
| JP | 1-64870 | U | 4/1989 |
| JP | 2-277983 | A | 11/1990 |
| JP | 10-252653 | A | 9/1998 |
| JP | 2004-232578 | A | 8/2004 |
| JP | 2005-98268 | A | 4/2005 |

(Continued)

OTHER PUBLICATIONS

International Search Report dated Jun. 27, 2006 with English translation (Four (4) Pages).

*Primary Examiner* — Charles Freay
*Assistant Examiner* — Patrick Hamo
(74) *Attorney, Agent, or Firm* — Crowell & Moring LLP

(57) ABSTRACT

To maintain the functionality as a compact and inexpensive motor-mounted internal gear pump and also offer further inexpensiveness and reliability. The motor-mounted internal gear pump 80 has a pump part 81 including: an inner rotor 1, an outer rotor 2, a pump casing and an internal shaft 5. The pump casing has flat inner surfaces facing both end faces of the inner rotor 1 and the outer rotor 2. The internal shaft 5 includes a bearing 51 which is inserted into an axial hole of the inner rotor 1 and a fitting part 53 extending from both its ends in both axial directions. The pump casing includes two pump casing members 3, 4 as separate members with flat inner surfaces 25, 26 respectively. The fitting part 53 of the internal shaft 5 is fitted in to fitting holes 27*a*, 28*a* made in the flat inner surfaces of the two pump casing members 3, 4 and the two pump casing members 3, 4 are connected with each other outside the outside diameter of the outer rotor while both end faces of the bearing 51 are in contact with the flat inner surfaces 25, 26.

8 Claims, 5 Drawing Sheets

U.S. PATENT DOCUMENTS

| | | | | |
|---|---|---|---|---|
| 5,219,276 | A | 6/1993 | Metzner et al. | |
| 6,313,990 | B1 * | 11/2001 | Cheon | 361/699 |
| 6,585,498 | B2 | 7/2003 | Arbogast et al. | |
| 2005/0186089 | A1 | 8/2005 | Nakayoshi et al. | |
| 2005/0265860 | A1 | 12/2005 | Kameya et al. | |

FOREIGN PATENT DOCUMENTS

| | | | |
|---|---|---|---|
| JP | 2005-273648 | A | 10/2005 |
| JP | 2005-337084 | A | 12/2005 |
| JP | 2003-529019 | A | 9/2006 |
| WO | WO 2006/129657 | A1 | 12/2006 |

* cited by examiner

MOTOR-MOUNTED INTERNAL GEAR PUMP AND MANUFACTURING METHOD THEREOF AND ELECTRONIC EQUIPMENT

TECHNICAL FIELD

The present invention relates to a motor-mounted internal gear pump, a manufacturing method thereof and electronic equipment.

BACKGROUND ART

Internal gear pumps have long been known as pumps which discharge sucked liquid against pressure, and particularly have been popular as hydraulic source pumps or oil feed pumps.

An internal gear pump includes, as main active components, a spur gear type inner rotor with teeth on its outer surface, and an annular outer rotor with teeth on its inner surface which has almost the same width as the inner rotor. A casing, which has flat inner surfaces facing both side faces of these rotors with a small gap, is provided to house the rotors. The number of teeth of the inner rotor is usually one smaller than that of the outer rotor, and the rotors rotate with their teeth meshed with each other, like power transmission gears. As the groove area changes with this rotation, the liquid trapped in the grooves is sucked or discharged so that the function as a pump is performed. When one of the inner and outer rotors is driven, the other rotor, meshed with it, rotates as well. Since the center of rotation is different between the rotors, each rotor must be pivotally supported in a rotatable manner individually. The casing has at least one so-called suction port and at least one so-called discharge port as openings to flow channels communicated with the outside. The suction port is designed to communicate with a groove whose volume increases and the discharge port is designed to communicate with a groove whose volume decreases. As for rotor profiles, typically, the outer rotor profile includes an arc and the inner rotor teeth are trochoidal teeth.

Since the internal gear pump rotates with its inner rotor and outer rotor meshed, when one rotor is driven, the other rotor rotates as well. When a motor part is integral with the outer surface of a-pump part and the rotator of the motor part is integral with the outer rotor and the motor part drives the outer rotor, this structure can be shorter than a structure in which the pump part and the motor part are arranged in series along the axial direction and is thus suitable for a compact pump.

An example of this type of internal gear pumps is the one disclosed in Japanese Patent Application Laid-Open Publication No. H2-277983 (Patent Document 1). According to Patent Document 1, the internal gear pump includes an internal gear which combines an outer gear (equivalent to an outer rotor) having a rotor on its outer surface to face and contact a stator fitted in a motor casing, with a given gap inside the stator in the radial direction, and an inner gear (equivalent to an inner rotor) to mesh with this outer gear, wherein both end faces of the internal gear are liquid-tightly closed by end plates and one of the end plates has a suction port and a discharge port which communicate with the internal gear. The end plates include a front casing and a rear casing; disc thrust bearings are disposed between the casings and both sides of the internal gear pump; and both sides of the outer gear are supported by the thrust bearings; both ends of a support shaft are fixed to the casings and the inner gear is rotatably supported by the support shaft through a radial bearing; and also a liquid feed channel is provided to allow some of the pressurized liquid on the discharge side to flow between the rotor and stator and lubricate the bearings and flow back to the suction side.

Patent Publication 1: Japanese Patent Application Laid-Open Publication No. H2-277983

DISCLOSURE OF THE INVENTION

Problem to be Solved by the Invention

However, according to Patent Document 1, the pump casing is composed of two thrust bearings, a front casing, a rear casing and a stator can. This structure has a problem that since many members must be manufactured and combined, the cost may be higher and reliability may be lower because of increase in the number of sealing points for prevention of leakage.

Furthermore, according to Patent Document 1, the distance between the two thrust bearings is limited by the distance between the front casing and rear casing at both sides and the distance between the front casing and rear casing is limited by the axial length of the stator can. In such structure, it would be difficult to control the distance between the two thrust bearings' portions facing the inner gear and outer gear accurately, and friction resistance in rotation between the inner gear and outer gear and the two thrust bearings would increase and in an extreme case, rotation might be impossible.

An object of the present invention is to provide a motor-mounted internal gear pump which assures further inexpensiveness and reliability while maintaining the functionality as a compact, inexpensive motor-mounted internal gear pump, and a manufacturing method thereof and electronic equipment.

Means for Solving the Problems

In order to achieve the above object, in a first mode of the invention, a motor-mounted internal gear pump includes: a pump part which sucks and discharges a liquid, and a motor part which drives the pump part; the pump part includes an inner rotor with teeth on its outer surface and an axial hole penetrating its center, an outer rotor with teeth on its inner surface to mesh with the teeth of the inner rotor and a tooth width almost the same as the inner rotor, a pump casing which houses the inner rotor and the outer rotor, and an internal shaft which is inserted into the axial hole and pivotally supports the inner rotor; the pump casing includes flat inner surfaces facing both end faces of the inner rotor's teeth portion and both end faces of the outer rotor's teeth portion, with a small gap; the motor part includes a rotator located inside the pump casing and integral with the outer rotor, and a stator which applies a revolving magnetic field to the rotator to rotate it, wherein the internal shaft includes a cylindrical bearing which has an outside diameter slightly smaller than the inside diameter of the axial hole of the inner rotor and is slightly longer than the tooth width of the inner rotor in the axial direction, and a fitting part which extends from both end faces of the bearing in both axial directions and has an outside diameter smaller than the outside diameter of the bearing; the pump casing comprises two pump casing members as separate members forming the flat inner surfaces at both sides; the fitting part of the internal shaft is fitted into fitting holes made in the flat inner surfaces of the two pump casing members; and the two pump casing members are connected with each other outside the outside diameter of the outer rotor with the flat inner surfaces in contact with both end faces of the bearing of the internal shaft.

Preferred concrete examples in the first mode of the invention are as follows.

(1) The two casing members are made of synthetic resin and one of them has a cylindrical can axially extending outward from its flat inner surface, and the can is softer than the flat inner surface in terms of axial rigidity, and the casing members are connected at the tip side of the can.

(2) In the example mentioned above in (1), the two casing members are connected by ultrasonic welding on connecting surfaces to which a force is axially applied.

(3) The pump casing is structured by connecting a front casing as a synthetic resin casing member with a suction port and a discharge port formed therein and a rear casing as another synthetic resin casing member by ultrasonic welding.

(4) In the example mentioned above in (3), in the rear casing, a thin-walled cylindrical can continuous with the outside of the flat inner surface surrounds the outer periphery of the outer rotor; a radially expanding flange is provided on an end face of the can's portion opposite to its portion continuous with the flat inner surface; the welding area is formed on an end face of the flange; a cover is continuous with the outer periphery of the end face outside the can in the form of an axially folded concentric cylinder; and the stator is housed in a cylindrical space surrounded by the can and the cover.

(5) In the example mentioned above in (4), the welding area for the front casing and the rear casing is formed in an area except an area which constitutes a flow channel along with the suction port and the discharge port.

In a second mode of the present invention, a motor-mounted internal gear pump includes a pump part which sucks and discharges a liquid, a motor part which drives the pump part; and a control part which controls the motor part; the pump part includes an inner rotor with teeth on its outer surface and an axial hole penetrating its center, an outer rotor with teeth on its inner surface to mesh with the teeth of the inner rotor and a tooth width almost the same as the inner rotor, a pump casing which houses the inner rotor and the outer rotor, and an internal shaft which pivotally supports the inner rotor; the pump casing includes flat inner surfaces facing both end faces of the inner rotor's teeth portion and both end faces of the outer rotor's teeth portion, with a small gap; the motor part includes a rotator as a permanent magnet located inside the pump casing and integral with the outer rotor, and a stator which applies a revolving magnetic field to the rotator to rotate it; the control part includes a circuit board with a control device, a power supply line for supplying electric current to the stator, and a power input line to which current is supplied from an external source, wherein the outer rotor has bracket sections as annular extensions of its outer periphery in both axial directions; inner surfaces of the bracket sections rotatably fit a cylindrical outer surface of the pump casing with a small gap, constituting radial sliding bearings; when the tooth width of the inner rotor and the outer rotor is expressed as 1, the outside diameter of the inner rotor is 1.7-3.4, the inside diameter of the outer rotor bracket sections is 2.5-5, and the axial length of the outer rotor bracket sections is 0.4-0.8; and inner rotor rotation speed is in the range of 2500-5000 rpm.

A third mode of the present invention is electronic equipment in which one of the above motor-mounted internal gear pumps is mounted as a cooling liquid circulation source.

A fourth mode of the present invention is a method of manufacturing a motor-mounted internal gear pump which includes a pump part which sucks and discharges a liquid, and a motor part which drives the pump part, the pump part including an inner rotor with teeth on its outer surface and an axial hole penetrating its center, an outer rotor with teeth on its inner surface to mesh with the teeth of the inner rotor and a tooth width almost the same as the inner rotor, a pump casing which houses the inner rotor and the outer rotor, and an internal shaft which is inserted into the axial hole and pivotally supports the inner rotor, the pump casing including flat inner surfaces facing both end faces of the inner rotor's teeth portion and both end faces of the outer rotor's teeth portion, with a small gap, the motor part including a rotator located inside the pump casing and integral with the outer rotor, and a stator which applies a revolving magnetic field to the rotator to rotate it; the method includes the steps of making the internal shaft including: a cylindrical bearing which has an outside diameter slightly smaller than the inside diameter of the axial hole of the inner rotor and is slightly longer than the tooth width of the inner rotor in the axial direction, and a fitting part which extends from both end faces of the bearing in both axial directions and has an outside diameter smaller than the outside diameter of the bearing; making a front casing having the flat inner surface and a fitting hole; making a rear casing having the flat inner surface, a fitting hole and a can extending cylindrically from the outer periphery of the flat inner surface part; and fitting the fitting part at both sides of the internal shaft into the fitting hole of the front casing and the fitting hole of the rear casing, and connecting the front casing and the rear casing each other outside the outside diameter of the outer rotor with the front casing's flat inner surface and the rear casing's flat inner surface in contact with both end faces of the bearing of the internal shaft.

A preferred concrete example in the fourth mode of the present invention is as follows.

(1) The fitting part at both sides of the internal shaft is fitted into the fitting hole of the front casing and the fitting hole of the rear casing, and the front casing and the rear casing are connected by ultrasonic welding, giving their connection area a force to bring them closer to each other axially, with the front casing's flat inner surface and the rear casing's flat inner surface in contact with both end faces of the bearing of the internal shaft.

Effect of the Invention

According to the present invention, it is possible to provide a motor-mounted internal gear pump which maintains the functionality as a compact, inexpensive motor-mounted internal gear pump and also offers further inexpensiveness and reliability, and a manufacturing method thereof and electronic equipment.

BEST MODE FOR CARRYING OUT THE INVENTION

Next, a motor-mounted internal gear pump, a manufacturing method thereof and electronic equipment according to an embodiment of the present invention will be described referring to FIGS. 1 to 6.

First, the general structure of a motor-mounted internal gear pump according to this embodiment will be described referring to FIGS. 1 and 4. FIG. 1 is a longitudinal sectional view of a motor-mounted internal gear pump 80 according to an embodiment of the present invention; FIG. 2 is a sectional front view showing the left half of the pump 80 in FIG. 1; FIG. 3 is an exploded perspective view of the pump part of the pump 80 in FIG. 1; and FIG. 4 is a sectional view showing how to connect the casings of the pump 80 in FIG. 1.

The pump 80 is a motor-mounted internal gear pump which includes a pump part 81, a motor part 82, and a control part 83.

The pump part 81 includes an inner rotor 1, an outer rotor 2, a front casing 3, a rear casing 4 and an internal shaft 5. The front casing 3 and rear casing 4 are members which constitute a pump casing: in other words, the pump casing member consists of two separate pump casing members. The rear casing 4 includes a can 6, a flange 18 and a cover 13. The internal shaft 5, which constitutes a shaft for supporting the inner rotor, is a member separate from the front casing 3 or the rear casing 4 in this embodiment.

The inner rotor 1 is similar in shape to a spur gear and has trochoidal teeth 1*a* on its outer surface. Strictly speaking the tooth surface is slightly angled in the axial direction, making an angle called a "draft angle" which facilitates drafting in injection molding. Also, the inner rotor 1 has, in its center, an axial hole 1*b* with a smooth inner surface which penetrates it axially. Both end faces 1*c* of the inner rotor 1 are flat and smooth and constitute sliding surfaces between the flat inner surfaces 25, 26 as the end faces of center annular parts 27, 28 protruding inward from the front casing 3 and rear casing 4.

The outer rotor 2 takes the form of an annular internal gear having almost the same tooth width as the inner rotor 1 and has arched teeth where the number of teeth is one larger than the number of teeth of the inner rotor 1. The teeth 2*a* of the outer rotor 2 as a spur gear have a sectional profile which is almost constant in the axial direction; however, they may be slightly angled in the axial direction, or have an angle called a "draft angle" to facilitate drafting in injection molding. In this case, the inner rotor 1 should have a similar draft angle and the inner rotor 1 and the outer rotor 2 are angled in opposite directions and the rotors 1, 2 are meshed so that the inner teeth diameter of the outer rotor 2 increases in the direction in which the outer teeth diameter of the inner rotor 1 increases. This can prevent the meshing surfaces of the rotors 1, 2 from contacting each other unevenly in the axial direction. Both end faces 2*b* of the teeth of the outer rotor 2 are flat and smooth and constitute sliding surfaces between the flat inner faces 25, 26 of the front casing 3 and rear casing 4 and function as thrust bearings.

The outer rotor 2 has almost the same width as the inner rotor 1 except its outer periphery, and the outer rotor 2 is disposed outside the inner rotor 1 in a way that both end faces of the inner rotor 1 almost coincide with those of the outer rotor 2.

The inner rotor 1 and outer rotor 2 are formed from a self-lubricating synthetic resin in which swelling or corrosion caused by water or an aqueous solution is negligible, such as polyacetal (POM) or polyphenylene sulfide (PPS).

Annular bracket sections 21, which protrude axially from the teeth portion (which has almost the same tooth width as the inner rotor 1 located inside), are formed on the outer periphery of the outer rotor 2. The inner surfaces of the bracket sections 21 are smooth and constitute sliding surfaces between the outer surfaces 27, 28 of the shoulder sections 22.

The outer rotor 2 and inner rotor 1 are designed to rotate between the front casing 3 and rear casing 4 while meshed with each other. A bearing of the internal shaft 5 with a smooth outer surface is fitted into the central axial hole of the inner rotor 1 with a small gap, and thus the inner rotor 1 is pivotally supported by the internal shaft 5 in a rotatable manner. The internal shaft 5 does not rotate because it is tightly fitted into the front casing 3 and rear casing 4.

The internal shaft 5 includes: a cylindrical bearing 51 which has an outside diameter slightly smaller than the inside diameter of the axial hole 1*b* of the inner rotor 1 and is slightly longer than the tooth width of the inner rotor 1 in the axial direction; and a fitting part 53 which extends from both end faces of the bearing 51 in both axial directions and has an outside diameter smaller than the outside diameter of the bearing 51. Concretely, the axial length of the bearing 51, located in the center of the internal shaft 5, is slightly (for example, 0.05-0.1 mm) longer than the tooth width of both rotors. The cylindrical fitting part 53, located at each end of the bearing 51, is concentric with the bearing 51. The bearing 51 and the fitting part 53 are parts of the internal shaft 5 which are all made of the same metal material, and integral with each other. The internal shaft 5, made of a metal material, is superior in strength and dimensional accuracy to the inner rotor 1, outer rotor 2, front casing 3 and rear casing 4 which are made of synthetic resin.

The internal shaft 5 also has the function as a structural member which connects the front casing 3 and the rear casing 4. Its fitting part 53 is inserted and fixed into fitting holes 27*a*, 28*a* made in the flat inner surfaces 25, 26 of both casings 3, 4. In this condition, the step faces (both end faces of the bearing 51) 51*a* as boundaries between the bearing 51 and the fitting part 53 are in close contact with the flat inner surfaces 25, 26 of the casings. This means that the length of the bearing 51 is equal to the distance (interval) between both flat inner surfaces 25, 26, and both rotors 1, 2 are inside the flat inner surfaces 25, 26 as the axial end faces of the front casing 3 and rear casing 4, with a small gap. The fitting holes of the front casing 3 and rear casing 4 are eccentric with respect to the shoulder sections 22 in a way to accommodate both rotors 1, 2 which are meshed.

The outer surfaces 27, 28 of the shoulder sections 22 of the front casing 3 and rear casing 4 are fitted to the inner surfaces of the bracket sections 21 of the outer rotor 2 with a small gap; and the shoulder sections 22 of the front casing 3 and rear casing 4 pivotally supports both sides of the outer rotor 2 in a rotatable manner, functioning as radial bearings. The shoulder sections 22 of the front casing 3 and rear casing 4 are in a positional relation as if they originated from a single cylinder.

The front casing 3, one of the two pump casing members, has a hole called a suction port 8 and a hole called a discharge port 10 in its flat inner surface 25. The suction port 8 and the discharge port 10 are holes whose profile extends inside the tooth-base circle of the inner rotor 1 and outside the tooth-base circle of the outer rotor 2 (since the outer rotor 2 is an internal gear, its tooth-base circle diameter is larger than its tooth-tip circle diameter). The suction port 8 faces a working chamber 23 whose volume increases and the discharge port 10 faces a working chamber 23 whose volume decreases. When the volume of a working chamber 23 is maximized, either port 8, 9 does not face the working chamber 23 or is communicated with it only through a small sectional area.

The suction port 8 and discharge port 10 are respectively communicated from the innermost port grooves through an L-shaped flow channel with a suction hole 7 and a discharge hole 9 which are open to the outside. Midway in the flow channel from the discharge port 10 to the discharge hole 9, there is a branched communication path 9*a*which communicates with an internal space 24 facing the outer surface of the outer rotor 2. The internal space 24 is a space surrounded by the front casing 3 and the rear casing 4 including the can 6.

The motor part 82 includes a rotator 11 as a permanent magnet, a stator 12 and a can 6. The can 6 is shared by the pump part 81 and the motor part 82.

A permanent magnet as the rotator 11 of the motor part 82 is integrated with the outside of the outer rotor 2. It may be integrated by a method which assures sufficient strength and reliability, such as bonding or press-fitting, after forming the outer rotor 2 and the permanent magnet as separate members, and the outer rotor 2 and the rotator 11 are formed as an integrated member by resin mixed with magnetic powder. The rotator 11 provides alternate polarities in the radial direction and when viewed from outside, it has N and S poles arranged alternately along its circumference.

The can 6, a thin-walled cylinder, is located with a small gap from the outer surface of the rotator 11 (for example, gap of 1 mm or less), so that the rotator 11 can rotate together with the outer rotor 2.

The rear casing 4, one of the two casing members, has a cylindrical can 6 covering the outside of the outer rotor 2 and axially extending outward from the portion constituting its flat inner surface 26, where the can 6 side is softer than the flat inner surface 26 side in terms of axial rigidity; and at the tip side of the can 6, it is connected with the front casing 3, one of the two casing members. In other words, the can 6 is part of the rear casing 4 and refers to a cylindrical thin portion extending frontward and outward from the portions constituting the flat inner surface and shoulder section.

The front casing 3 and rear casing 4 contact each other on a cylindrical surface called a fitting surface 16, engaging with each other with freedom in axial movement while binding each other in the radial direction. The fitting surface 16 consists of a fitting surface between the inner surface of the tip of the can 6 and the outer surface of the outer annular part 29 formed inside the front casing 3. A dent is formed in the inner surface of the tip of the can 6 adjacent to the fitting surface 16 and an O ring 14 inserted into this dent keeps confidentiality between the front casing 3 and rear casing 4. Such structure allows the front casing 3 and rear casing 4 to be combined in a confidentiality manner while assuring freedom in the axial direction.

Plural welding projections 41 which are annular and oriented rearward are formed near the outer surface of the front casing 3 and annular welding grooves 42 into which the welding projections 41 are inserted are formed in the flange 18 of the rear casing 4. In this embodiment, as shown in FIG. 4, the tip of a welding projection 41 has a slanted surface and the bottom of a welding groove 42 has a slanted surface to match the abovementioned slanted surface and welding tools 43, 44 are pushed against the outer surface of the front casing 3 and the flange 18 of the rear casing 4 from both sides and micro-vibrations are given to the welding tools 43, 44 with a force applied to the welding tools 43, 44. Concretely, the welding tools 43, 44 are attached to an ultrasonic welder to give them ultrasonic vibrations. Consequently, the surface of contact between both casings 3, 4 generates heat due to micro-vibration friction and melts and they fuse with each other; after vibrations stop, as the temperature goes down, they are re-solidified and connected. For this reason, the back side of the welding projection 41 of the front casing 3 and the back side of the welding groove 42 of the rear casing 4 should be flat and open so that the welding tools 43, 44 can be placed in tight contact with them.

The groove on the rear casing 4 into which the welding tool 44 is inserted is an annular groove into which the stator 12 is inserted after welding and can be smaller and simpler in shape than a groove dedicated to welding.

Any contact that limits axial movement, except two points of contact, contact between the welding projection 41 and the welding groove 42 and contact between the internal shaft 5 step and the flat inner surface 25, 26, should be eliminated before completion of welding. The can 6 is thin-walled and the can and its vicinity are softer than the flat inner surfaces, the shoulder sections and the areas around welding points. This establishes a positional relationship among members in the following order.

First, the fitting part 53 of the internal shaft 5 is inserted in the rear casing 4; the inner rotor 1 and outer rotor 2 are fitted into the internal shaft 5; and the front casing 3 with the O ring 14 fitted thereon is fitted to the rear casing 4. In this condition, the welding tools 43, 44 are applied to both casings 4, 5 from both sides and ultrasonic vibrations are given to them while they are pushed with a prescribed force. Consequently the point of contact between the welding projection 41 and welding groove 42 melts and the front casing 3 and rear casing 4 come closer to each other. In this process, the step faces 51*a* of the internal shaft 5 come into tight contact with the flat inner surfaces 25, 26. As welding goes on, the can 6 of the rear casing 4 and its vicinity are elastically deformed and welding goes deeper. Vibrations are stopped with a force on the welding tools 43, 44 and the molten welded parts cool down and solidify, settling into shape. Even after the welding tools are removed, the step faces 51*a* of the internal shaft 5 remain in contact with the flat inner surfaces 25, 26 and that contact force remains a reactive force against elastic deformation of the can 6 and its vicinity.

The internal shaft 5 is made of metal and easier to manufacture with required dimensional accuracy in the axial direction than the resin casing members 3, 4. It is also advantageous in that dimensional accuracy in the tooth width direction is assured in its central part adjacent to the teeth of the rotors 1, 2. It is far easier to maintain accuracy than in the method in which accuracy in the distance between both flat inner surfaces 25, 26 is assured only by dimensional accuracy of the casings 3, 4 through the outer periphery of the can 6, etc. without relying on accuracy of the internal shaft 5. Hence the structure in this embodiment is effective in keeping the gap at tooth end faces, which has a large influence on pump performance and reliability, adequate The welding projection 41 is annular but not a continuous circle and there are missing parts in the circumference as shown in FIG. 2. The reason for this is that a pushing force as applied to a limited area is more concentrated than as applied to the whole circumference and thus welding is done more securely. The suction and discharge flow channels lie in the missing parts in order to prevent interference between the welding tool 43 and these flow channels.

Thanks to the function of the fitting surface 16, the two casings are combined with high positioning accuracy in the radial direction, and their axial positional accuracy is maintained by contact between the internal shaft 5 and the flat inner surfaces 25, 26. The internal space 24 is hermetically sealed by the O ring 14 and there are no holes or fitting surfaces communicated with the outside except the suction hole 8 and discharge hole 10 and this simple structure is highly liquid-tight. Hence, it prevents liquid leakage with reliability.

The cover 13 is integrally molded as a backwardly folded extension from the flange 18 on the front side of the can 6 which is continuous with the rear casing 4. The cover 13, which covers the outer surface of the stator 12 of the motor part 82, is useful in preventing electric shock, keeping a good appearance and shutting off the noise.

The stator 12 is press-fitted into the outer surface of the can 6 outside the can 6 and opposite to the rotator 11 where the stator 12 consists of a winding around a comb-shaped iron core. The stator 12 is fitted into a circular groove formed between the can 6 and the cover 13. Since the motor part 82, composed of the rotator 11 and the stator 12, is located around the pump part 81, composed of the inner rotor 1 and the outer rotor 2, namely the motor part 82 and the pump part 81 are not arranged in series along the axial direction, the pump 80 is thin and compact.

The control part 83, which is intended to control the motor part 82, is equipped with an inverter electronic circuit for driving a brushless DC motor. Since the motor part 82 is located around the pump part 81 as mentioned above, the control part 83 can be located on the rear side where the suction hole 7 and the discharge hole 9 of the pump part 81 are not located.

A power device 32 as a main electronic component is mounted on a circuit board 31, constituting an inverter circuit for driving a brushless DC motor. The circuit board 31 is fixed to the rear casing 4 by caulking, or passing a projection 45 on the back of the rear casing 3 through a hole in its center. The power device 32 contacts the rear casing 4 through the circuit board 31. Consequently, heat generated in the inverter circuit can be passed through the rear casing 4 into the liquid (being conveyed) in the pump part 81. The circuit board 31 is connected with one end of the winding of the stator 12 and also with a power line 33 for external power supply, a rotation output line 34 for transmitting rotation speed information by pulses and a common grounding line for them.

The brushless DC motor includes: the motor part 82 having the rotator 11 as a permanent magnet, and the stator 12; and the control part 83 having the inverter electronic circuit. The structure that the rotator 11 is inside the thin-walled can 6 and the stator 12 is outside the can 6 is called a "canned motor". Since the canned motor does not require a shaft seal, etc. and transmits the turning force to the inside of the so-called can 6 by the use of a magnetic force, it is suitable for the structure of a positive displacement pump which pumps out the liquid through change in the volume of the working chambers 23 while isolating the liquid from the outside.

When the pump 80 has dimensional relations as shown in FIG. 5, the object of the present invention is achieved better. When the width of the inner rotor 1 and the tooth width of the outer rotor 2 are expressed as 1, the outside diameter of the inner rotor should be 1.7-3.4, the inside diameter of the outer rotor bracket sections should be 2.5-5, and the axial length of the outer rotor bracket sections should be 0.4-0.8.

If the outside diameter of the inner rotor 1 is above this range, the rate of internal leakage (back flow from the higher pressure discharge port communicating side to the suction port communicating side, which deteriorates pump performance) would increase, deteriorating pump performance. If it is below the range, the velocity of flow would increase at opening areas where the working chambers communicate with the suction or discharge port, leading to increased pressure loss and deterioration in pump performance.

The inside diameter of the bracket section 21 of the outer rotor 2 must be geometrically larger than the outside diameter of the inner rotor 1. At the same time, if it is above this range, frictional force and internal leakage from bearing surfaces would increase, leading to deterioration in pump performance.

If the axial length of the outer rotor bracket section 21 is below this range, the bearing surface pressure might increase and thus frictional wear might increase, leading to shorter pump life and lower reliability. If it is above this range, it is disadvantageous because unevenness in contact easily occurs due to errors in bearing surface cylindricality and concentricity, etc.

It is recommended that the inner rotor rotation speed be within the range of 2500-5000 rpm. If the rotation speed is slower than this, the ratio of internal leakage to transportation flow rate would increase, leading to deterioration in pump efficiency. If it is faster than this, vibration noise generated by the pump would increase.

Next, how the pump 80 works will be explained referring to FIGS. 1 to 5.

By giving 12 V DC power to the power line 33 to supply electric current to the motor drive circuit of the control part 83, electric current is fed through the power device 32 to the winding of the stator 12. This starts the motor part 82 and controls it to rotate it at a preset rotation speed. Since the power device 32 outputs rotation information on the rotator 11 as a pulse signal through the rotation output line 34, a higher-level control apparatus which receives the signal can confirm the operating condition of the pump 80.

As the rotator 11 of the motor part 82 rotates, the outer rotor 2, united with it also rotates; as the rotation is transmitted like an ordinary internal gear, the inner rotor 1, meshed with it, also rotates. The volume of working chambers 23 formed in the grooves of the two rotors 1, 2 increases or decreases as both rotors 1, 2 rotate. As shown in FIG. 2, when the teeth of the inner rotor 1 and outer rotor 2 are meshed deepest, the volume of the working chamber 23 at the bottom is the minimum and the volume of the working chamber 23 at the top is the maximum. Hence, when the rotors rotate counterclockwise in FIG. 2, the working chambers 23 in the right half move up and their volume increases, while the working chambers 23 in the left half move down and their volume decreases. All the sliding parts pivotally supporting both rotors 1, 2 are immersed in the hydraulic fluid and therefore their friction is small and abnormal wear is prevented.

The liquid being conveyed passes through the suction hole 7 and then the suction port 8 and is sucked into the working chambers 23 whose volume is increasing. As the rotors rotate, the working chamber 23 whose volume is maximized leaves the profile of the suction port 8 and finishes its suction process, then communicates with the discharge port 10. Then, the volume of the working chamber 23 begins to decrease and the liquid in the working chamber 23 is discharged through the discharge port 10. The discharged liquid is sent out through the discharge hole 9. Since the branched communication path 9*a* lies midway in the discharge flow channel, the inner pressure of the internal space 24 is maintained at a discharge pressure level.

In this embodiment, since the suction flow channel is short, the negative pressure for suction is small, which prevents cavitation. In addition, a relatively high discharge pressure is applied to the inner surface of the can 6 to push and expand it outward and therefore even though the can 6 is thin-walled, it cannot be so deformed inward as to touch the rotator 11. At the same time, leakage from the gap as a radial bearing formed on the bracket section 21 of the outer rotor 2 can be reduced. The reason is that although the outward force of leakage from this gap is increased by a centrifugal force, if the inner pressure of the internal space 24 around it is high, there is an action which pushes it back.

In the power device 32, which must be cooled because it generates heat during operation, the heat passes through the wall of the rear casing 4 which the device contacts through the circuit board 31, and moves to the liquid flowing in the internal space 24 before being released outside. Since the liquid in the internal space 24 is always stirred and successively replaced due to minor leaks from the radial bearing surface, it carries away the heat efficiently. Since the inside of the pump 80 is cooled efficiently as described above, a heat sink or cooling fan for cooling the power device 32 is not needed. Similarly, the heat generated by motor loss in the rotator 11 or the stator 12 is carried away efficiently, which prevents an abnormal temperature rise.

Next, electronic equipment which has the above pump 80 will be described referring to FIG. 6. FIG. 6 is a perspective view showing a personal computer system configuration with a computer in its upright position. The electronic equipment shown in FIG. 4 is a desk top personal computer system.

The personal computer system 60 includes a personal computer 61A, a display unit 61B, and a keyboard 61C. A liquid-cooling system 69 is housed in the personal computer 61A together with a CPU (central processing unit) 62 and consists of a closed loop system in which a liquid reservoir 63, a pump 80, a heat exchanger 65, a heat radiating plate A66 and a heat radiating plate B67 are connected in the order of mention by tubing. This liquid-cooling system 69 is primarily intended to convey out the heat generated by the CPU 62 housed in the personal computer 61A and keep the temperature rise of the CPU 62 below a prescribed level. The liquid-cooling system 69, which uses water or an aqueous solution as a heat transfer medium, features a higher heat transfer capability and lower noise than an air-cooling system, so it is suitable for cooling the CPU 62 which generates much heat.

The liquid being conveyed and air are filled in the liquid reservoir 63. The liquid reservoir 63 and the pump 80 are placed side by side where the outlet of the liquid reservoir 63 and the suction hole of the pump 80 are connected by tubing. The heat exchanger 65 is bonded to the heat radiating surface of the CPU 62 through thermally conductive grease. The discharge hole of the pump 80 and the inlet of the heat exchanger 65 are communicated by tubing. The heat exchanger 65 is communicated with the heat radiating plate A66 by tubing; and the heat radiating plate A66 is communicated with the heat radiating plate B67 by tubing; and the heat radiating plate B67 is communicated with the liquid reservoir 63 by tubing. The heat radiating plate A66 and the heat radiating plate B67 are so located as to allow heat radiation from different surfaces of the personal computer 61A.

The pump 80 is connected with the power line 33 from a 12 V DC power supply usually provided in the personal computer system 60 and the rotation output line 34 is connected with the electronic circuit of the personal computer system 60 as a higher-level control apparatus.

Next, how this liquid-cooling system 69 works will be explained. As the personal computer system 60 is started, power is supplied, the pump 80 begins running and the liquid being conveyed begins circulating. The liquid is sucked from the liquid reservoir 63 into the pump 80 and pressurized by the pump 80 and sent to the heat exchanger 65. The liquid sent from the pump 80 to the heat exchanger 65 absorbs the heat emitted from the CPU 62 and the liquid temperature rises. Then, the heat of the liquid is exchanged for outside air through the heat radiating plate A66 and the heat radiating plate B67 (heat is released to the outside) and consequently the liquid temperature falls, then the liquid returns to the liquid reservoir 63. This process is repeated so that the CPU 62 is continuously cooled.

Since the pump 80 is an internal gear pump as a kind of positive displacement pump, even if it is started in a dry (no liquid) condition, it has the ability to make the suction hole have a negative pressure. Therefore, even when the liquid comes through a tube above the liquid level inside the liquid reservoir 63 or when the pump 80 is located at a higher position than the liquid level, the pump 80 has a self-priming ability to suck liquid without priming water. The internal gear pump 80 has a higher pressurizing ability than a centrifugal pump, etc, so it can also be used in such a condition that the liquid passes through the heat exchanger 65 and the heat radiating plates 66, 67 and thus liquid pressure loss increases. Particularly when the heat density of the CPU 62 is high, in order to increase the heat exchange area, the flow channel inside the heat exchanger 65 must be elongated by folding it; thus a liquid cooling system which uses a centrifugal pump, etc. would be difficult to use because of increased pressure loss in the liquid passing through the channel, while the liquid cooling system 69 according to this embodiment can cope with such a situation.

In the liquid cooling system 69 according to this embodiment, the liquid being conveyed passes through the heat radiating plates 66, 67 just after the outlet of the heat exchanger 65 where the liquid temperature is highest, and the liquid temperature falls, so the temperature of the liquid reservoir 63 and pump 80 is maintained at a relatively low level. For this reason, the internal parts in the pump 80 provide higher reliability than in a high temperature environment.

As a result of operation of the liquid cooling system 69, the temperature of each of the components through which the liquid circulates is determined and the temperature is monitored by a thermo sensor (not shown). If insufficiency of the cooling performance is confirmed by detection of a temperature above a prescribed level, a command is given to increase the rotation speed of the pump 80 to prevent an excessive temperature rise. Contrarily, if the cooling performance is too high, the rotation speed is decreased. The rotation output signal from the pump 80 is always monitored; if no rotation signal is sent and there is an abnormal change in the liquid temperature, the pump 80 is considered to be out of order and the personal computer system 60 enters an emergency mode. In the emergency mode, a fatal hardware damage is prevented by taking minimum necessary steps such as decreasing the CPU speed and saving current program data.

BRIEF DESCRIPTION OF THE DRAWINGS

FIG. [1] is a longitudinal sectional view of a motor-mounted internal gear pump according to an embodiment of the present invention.

FIG. [2] is a sectional front view showing the left half of the pump in FIG. 1.

Figure 1:
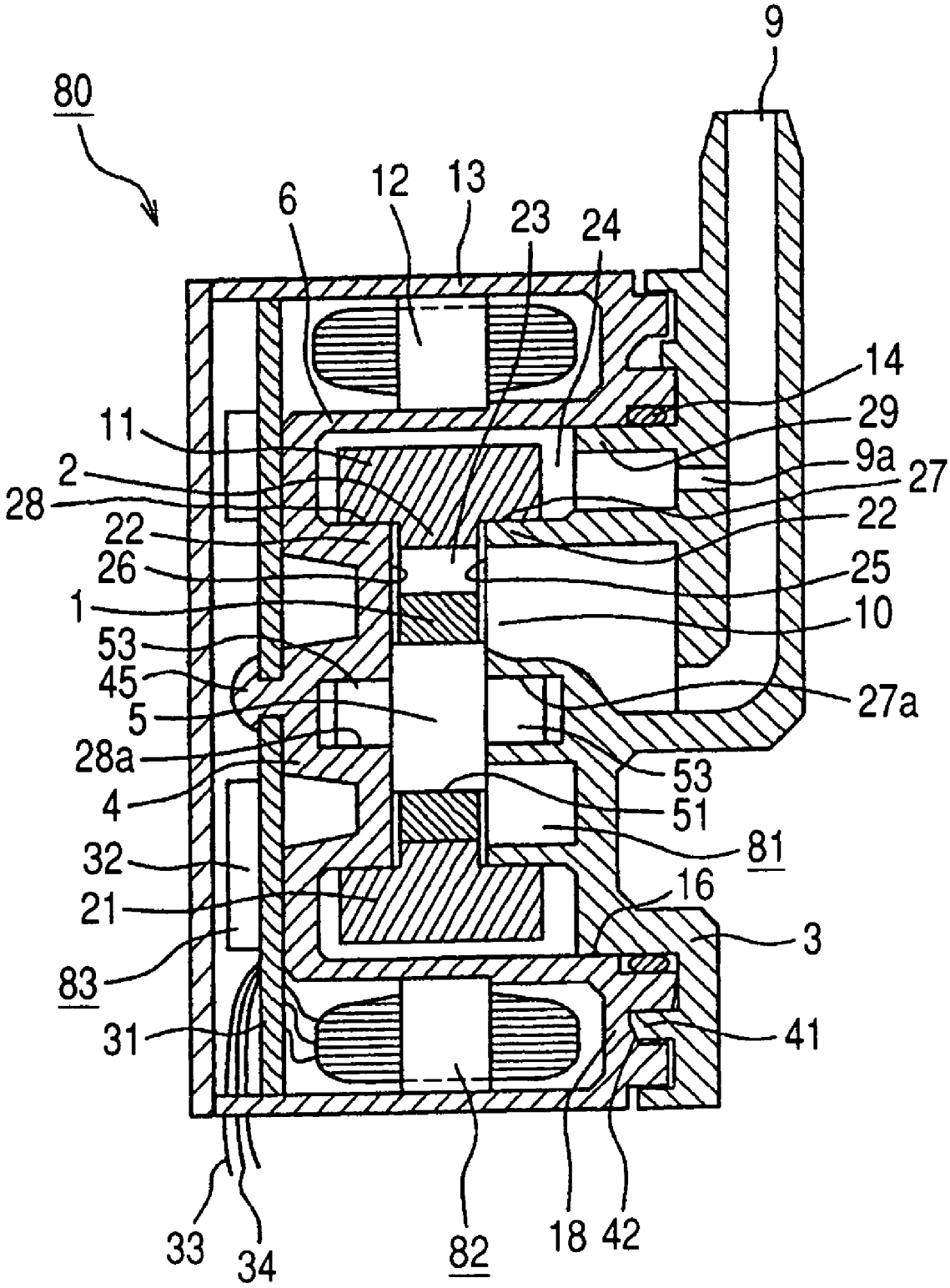
Figure 2:
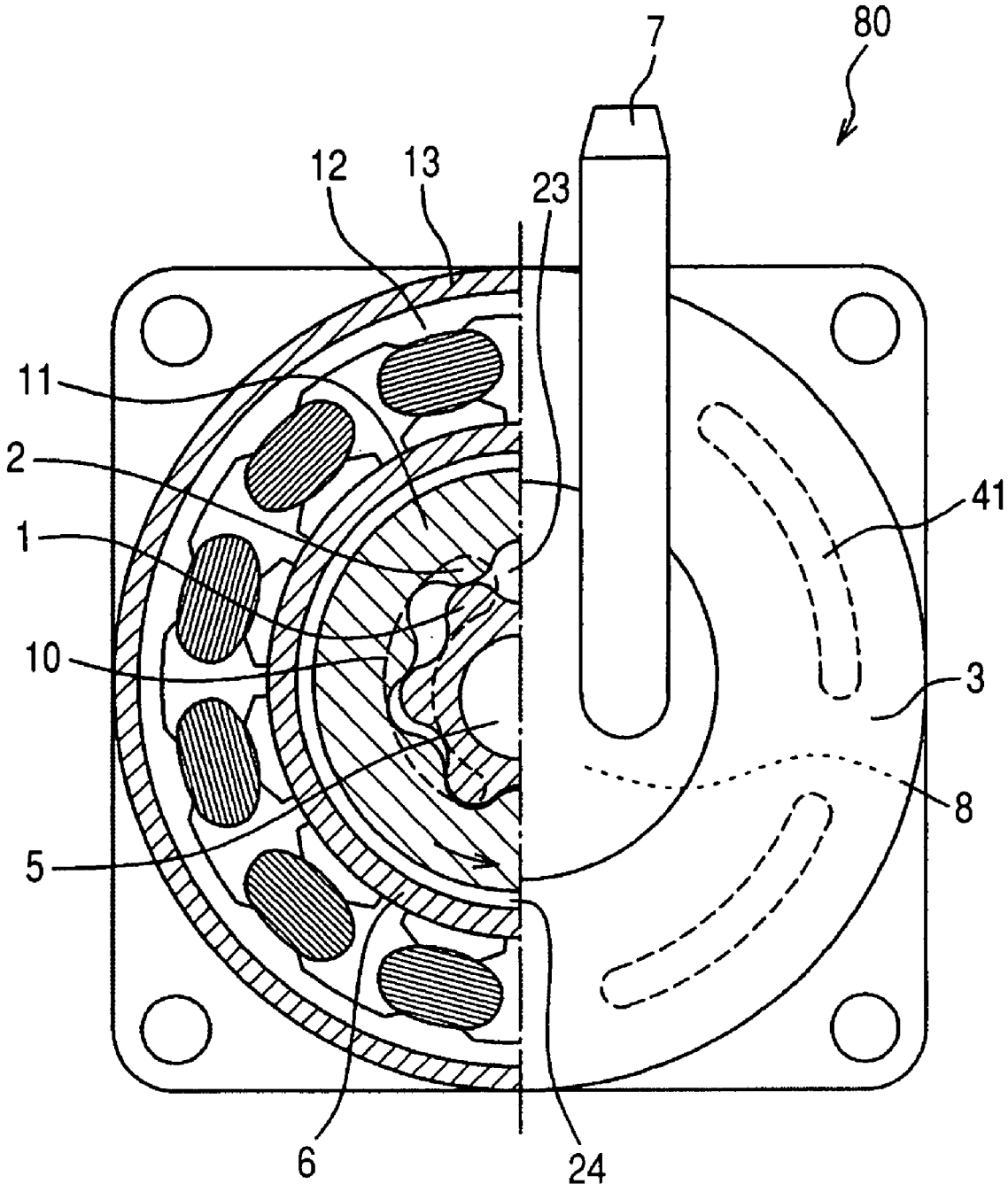
Figure 3:
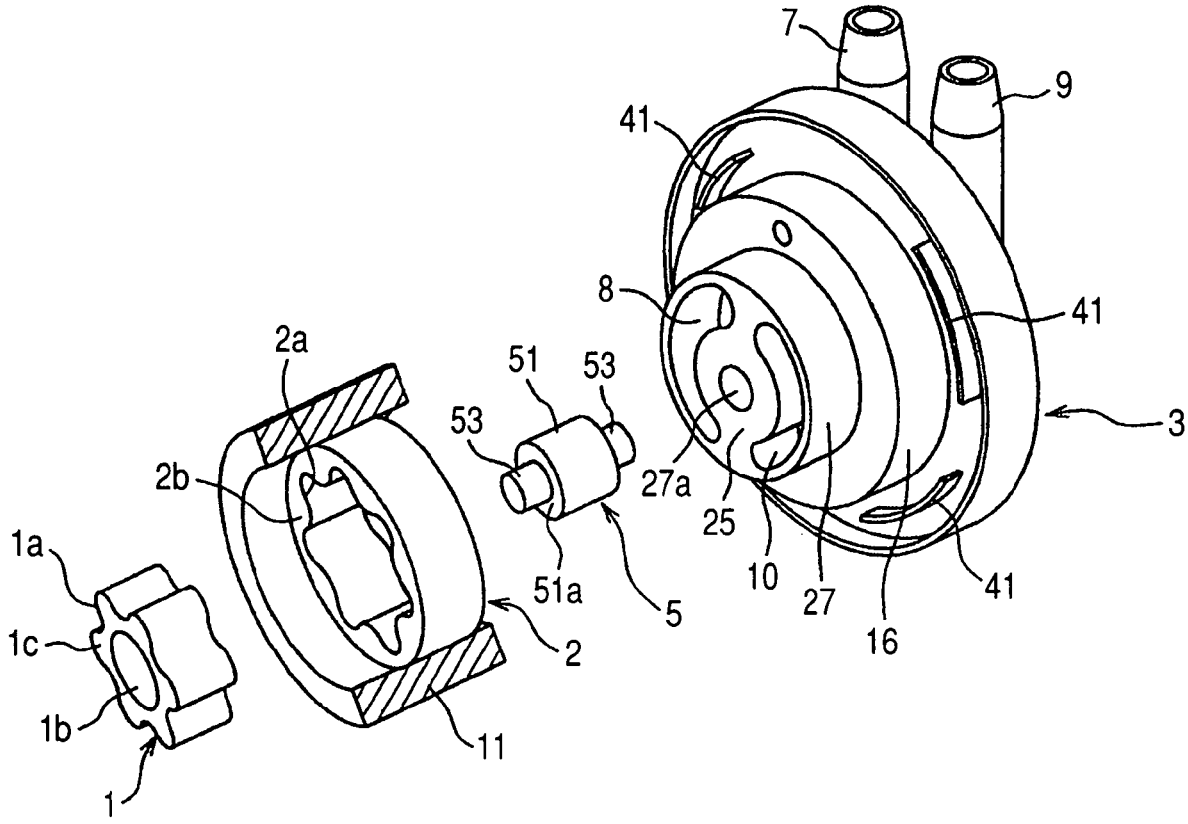
Figure 4:
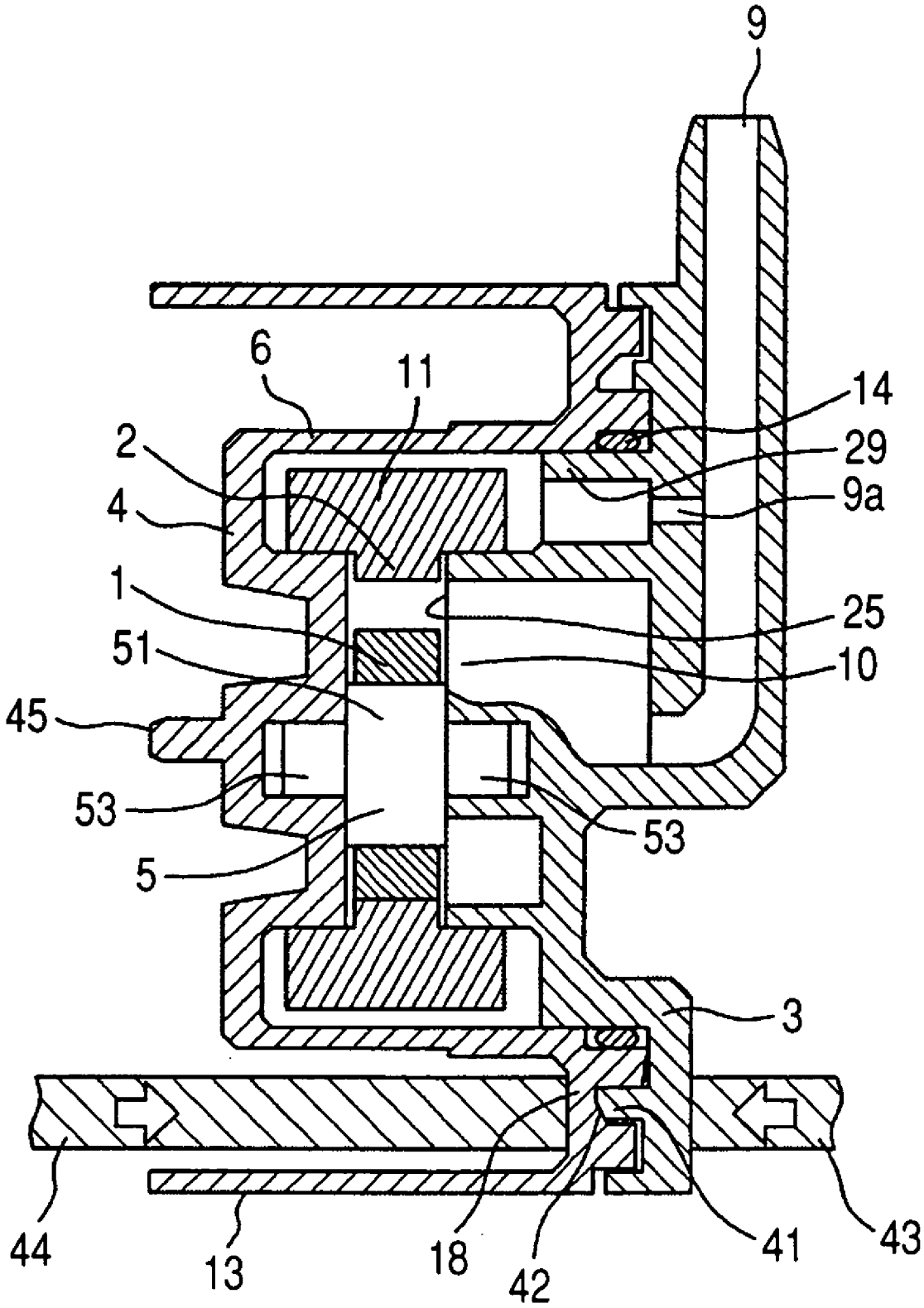
Figure 5A:
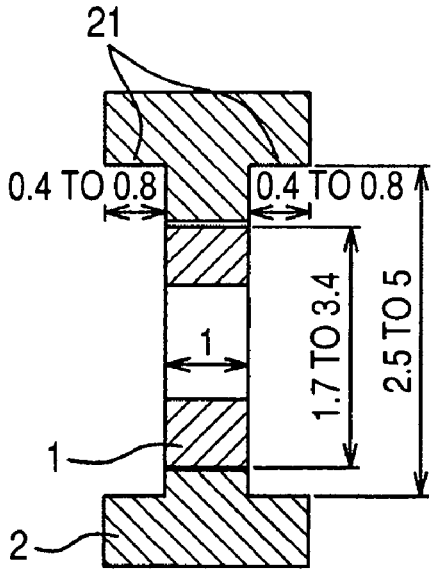
Figure 5B:
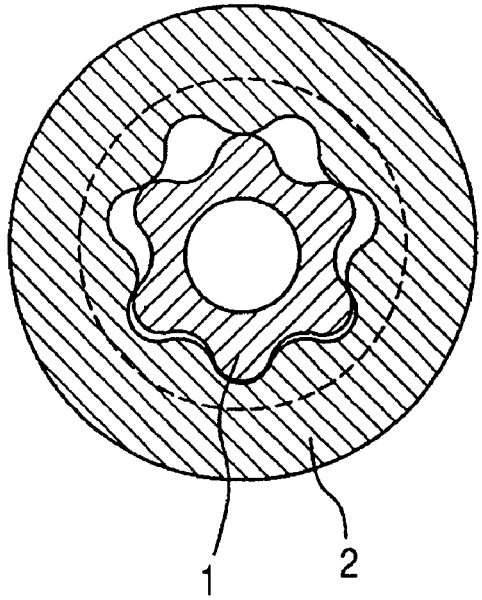
Figure 6:
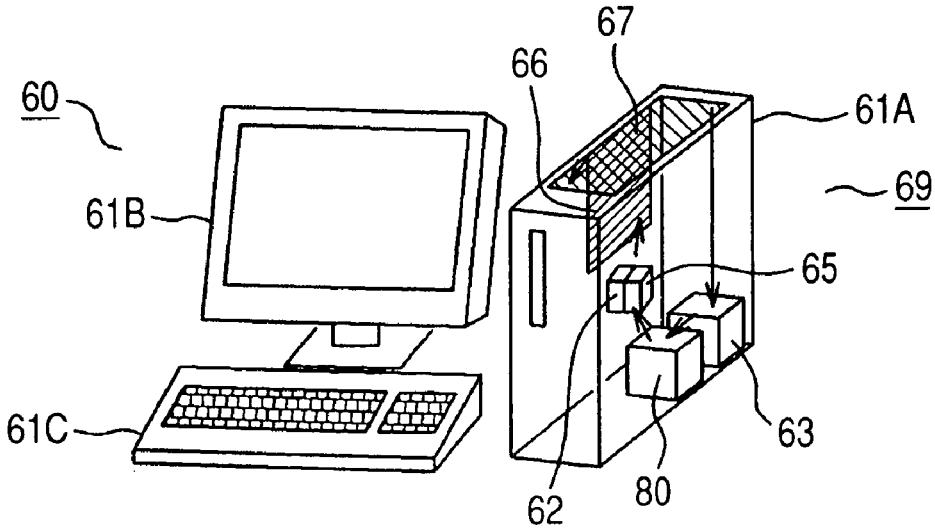

FIG. [3] is an exploded perspective view of the pump part of the pump in FIG. 1.

FIG. [4] is a sectional view showing how to connect the casings of the pump in FIG. 1.

FIG. [5] is a dimensional drawing of the inner rotor and outer rotor of the pump in FIG. 1.

FIG. [6] is an explanatory view of electronic equipment with a cooling system having the pump in FIG. 1.

EXPLANATION OF REFERENCE NUMERALS

1 . . . Inner rotor
1*a* . . . Teeth
1*b* . . . Axial hole
1*c* . . . End face
2 . . . Outer rotor
2*a* . . . Teeth
2*b* . . . End face
3 . . . Front casing
4 . . . Rear casing
5 . . . Internal shaft
6 . . . Can
7 . . . Suction hole
8 . . . Suction port
9 . . . Discharge hole
9*a* . . . Communication path
10 . . . Discharge port
11 . . . Rotator
12 . . . Stator
13 . . . Cover

14 . . . O ring
16 . . . Fitting surface
18 . . . Flange
21 . . . Bracket section
22 . . . Shoulder section
23 . . . Working chamber
24 . . . Internal space
25 . . . Front casing flat inner surface
26 . . . Rear casing flat inner surface
27, 28 . . . Shoulder section outer surfaces
27*a*, 28*a* . . . Fitting holes
29 . . . Outer annular part
31 . . . Circuit board
32 . . . Power device
33 . . . Power line
34 . . . Rotation output line
41 . . . Welding projection
42 . . . Welding groove
43 . . . Welding tool
44 . . . Welding tool
51 . . . Bearing
51*a* . . . Step face
53 . . . Fitting part
60 . . . Personal computer system
61A . . . Personal computer
61B . . . Display unit
61C . . . Keyboard
62 . . . CPU
63 . . . Liquid reservoir
65 . . . Heat exchanger
66 . . . Heat radiating plate A
67 . . . Heat radiating plate B
69 . . . Liquid-cooling system (cooling system)
80 . . . Motor-mounted internal gear pump
81 . . . Pump part
82 . . . Motor part
83 . . . Control part

The invention claimed is:

1. A motor-mounted internal gear pump comprising:
a pump part which sucks and discharges a liquid; and
a motor part which drives the pump part,
the pump part including:
an inner rotor with teeth on its outer surface and an axial hole penetrating its center;
an outer rotor with teeth on its inner surface to mesh with the teeth of the inner rotor;
a pump casing which houses the inner rotor and the outer rotor; and
an internal shaft which is inserted into the axial hole and pivotally supports the inner rotor,
the pump casing including:
flat inner surfaces facing opposite end faces of the teeth of the inner rotor and opposite end faces of the teeth of the outer rotor, with small gaps between the inner surfaces and the end faces,
the motor part including:
a rotator located inside the pump casing and integral with the outer rotor; and
a stator which applies a revolving magnetic field to the rotator to rotate it,
wherein the internal shaft includes a cylindrical bearing which has an outside diameter smaller than the inside diameter of the axial hole of the inner rotor and is longer than the widths of the teeth of the inner rotor, and a fitting part which extends from end faces of the bearing and has an outside diameter smaller than the outside diameter of the bearing;
the pump casing includes two pump casing members as separate members forming the flat inner surfaces;
the fitting part of the internal shaft is fitted into fitting holes made in the flat inner surfaces of the two pump casing members;
the two pump casing members are connected with each other outside the, outside diameter of the outer rotor with the flat inner surfaces in contact with said end faces of the bearing; and
wherein the two casing members are made of synthetic resin and one of them has a cylindrical can axially extending outward from a flat inner surface thereof, and the can is softer than the flat inner surface in terms of axial rigidity; and the casing members are connected at a tip side of the can.

2. The motor-mounted internal gear pump according to claim 1, wherein the two casing members are connected by ultrasonic welding on connecting surfaces to which a force is axially applied.

3. A motor-mounted internal gear pump comprising:
a pump part which sucks and discharges a liquid; and
a motor part which drives the pump part,
the pump part including:
an inner rotor with teeth on its outer surface and an axial hole penetrating its center;
an outer rotor with teeth on its inner surface to mesh with the teeth of the inner rotor;
a pump casing which houses the inner rotor and the outer rotor; and
an internal shaft which is inserted into the axial hole and pivotally supports the inner rotor,
the pump casing including:
flat inner surfaces facing opposite end faces of the teeth of the inner rotor and opposite end faces of the teeth of the outer rotor, with small gaps between the inner surfaces and the end faces,
the motor part including:
a rotator located inside the pump casing and integral with the outer rotor; and
a stator which applies a revolving magnetic field to the rotator to rotate it,
wherein the internal shaft includes a cylindrical bearing which has an outside diameter smaller than the inside diameter of the axial hole of the inner rotor and is longer than the widths of the: teeth of the inner rotor, and a fitting part which extends from end faces of the bearing and has an outside diameter smaller than the outside diameter of the bearing;
the pump casing includes two pump casing: members as separate members forming the flat inner surfaces;
the fitting part of the internal shaft is fitted into fitting holes made in the flat inner surfaces of the two pump casing members:
the two pump casing members are connected With each other outside the outside diameter of the outer rotor With the flat inner surfaces in contact with said end faces of the bearing; and
wherein the pump casing is structured by connecting a front casing as a synthetic resin casing member with a suction port and a discharge port formed therein and a rear casing as another synthetic resin casing member by ultrasonic welding.

4. The motor-mounted internal gear pump according to claim 3, wherein in the rear casing:
a thin-walled cylindrical can continuous with the outside of the flat inner surface surrounds the outer periphery of the outer rotor;

a radially expanding flange is provided on an end face of the can's portion opposite to its portion continuous with the flat inner surface;

a welding area is formed on an end face of the flange;

a cover is continuous with the outer periphery of the end face outside the can in the form of an axially folded concentric cylinder; and the stator is housed in a cylindrical space surrounded by the can and the cover.

5. The motor-mounted internal gear pump according to claim 3, wherein a welding area for the front casing and the rear casing takes the form of a circle with missing parts.

6. A motor-mounted internal gear pump comprising:

a pump part which sucks and discharges a liquid;

a motor part which drives the pump part; and a control part which controls the motor part, the pump part including:

an inner rotor with teeth on its outer surface and an axial hole penetrating its center;

an outer rotor with teeth on its inner surface to mesh with the teeth of the inner rotor;

a pump casing which houses the inner rotor and the outer rotor; and an internal shaft which pivotally supports the inner rotor, the pump casing including:

flat inner surfaces facing opposite end faces of the teeth of the inner rotor and opposite end faces of the teeth of the outer rotor, with small gaps between the inner surfaces and the end faces, the motor part including:

a rotator as a permanent magnet located inside the pump casing and integral with the outer rotor; and a stator which applies a revolving magnetic field to the rotator to rotate it, the control part including:

a circuit board with a control device;

a power supply line for supplying electric current to the stator; and a power input line to which current is supplied from an external source, wherein the outer rotor has bracket sections as annular extensions of its outer periphery;

inner surfaces of the bracket sections rotatably fit a cylindrical outer surface of the pump casing with a small gap, constituting radial sliding bearings;

when widths of the teeth of the inner rotor and the outer rotor is expressed as 1, the outside diameter of the inner rotor is 1.7-3.4, the inside diameter of the outer rotor bracket sections is 2.5-5, and the axial length of the outer rotor bracket sections is 0.4-0.8; and inner rotor rotation speed is in the range of 2500-5000 rpm.

7. Electronic equipment wherein the motor-mounted internal gear pump according to claim 6 is mounted as a cooling liquid circulation source.

8. A method of manufacturing a motor-mounted internal gear pump including:

a pump part which sucks and discharges a liquid; and a motor part which drives the pump part, the pump part having:

an inner rotor with teeth on its outer surface and an axial hole penetrating its center;

an outer rotor with teeth on its inner surface to mesh with the teeth of the inner rotor;

a pump casing which houses the inner rotor and the outer rotor; and an internal shaft which is inserted into the axial hole and pivotally supports the inner rotor, the pump casing having:

flat inner surfaces facing opposite end faces of the teeth of the inner rotor and opposite end faces of the teeth of the outer rotor, with small gaps between the inner surfaces and the end faces, the motor part including:

a rotator located inside the pump casing and integral with the outer rotor; and a stator which applies a revolving magnetic field to the rotator to rotate it, the method of manufacturing a motor-mounted internal gear pump comprising the steps of:

making the internal shaft including a cylindrical bearing which has an outside diameter smaller than the inside diameter of the axial hole of the inner rotor and is longer than widths of the teeth of the inner rotor, and a fitting part which extends from end faces of the bearing and has an outside diameter smaller than the outside diameter of the bearing;

making front casing having one of the flat inner surfaces and a fitting hole;

making a rear casing having another of the flat inner surfaces, a fitting hole and a can extending cylindrically from an outer periphery of the other of the flat inner surfaces;

fitting the fitting part into the fitting hole of the front casing and the fitting hole of the rear casing, and connecting the front casing and the rear casing with each other outside the outside diameter of the outer rotor with the front casing's flat inner surface and the rear casing's flat inner surface in contact, with end faces of the bearing of the internal shaft; and fitting the fitting part into the fitting hole of the front casing and the fitting hole of the rear casing, and connecting the front casing and the rear casing by ultrasonic welding, giving a connection area between the casings a force to bring them closer to each other axially, with the front casing's flat inner surface and the rear casing's flat inner surface in contact with the bearing of the internal shaft.

* * * * *